US007380746B2

(12) United States Patent
Weber et al.

(10) Patent No.: US 7,380,746 B2
(45) Date of Patent: Jun. 3, 2008

(54) METHOD AND APPARATUS FOR ACCUMULATING A WEB

(75) Inventors: Paul Alois Weber, Appleton, WI (US); Darin Allen Engelhart, Appleton, WI (US); Thomas Arthur Bett, Oshkosh, WI (US); Thomas Tanakon Ungpiyakul, Neenah, WI (US); Thomas Michael Killian, Sobieski, WI (US); Mark John Beitz, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 75 days.

(21) Appl. No.: 11/441,770

(22) Filed: May 26, 2006

(65) Prior Publication Data

US 2007/0125820 A1 Jun. 7, 2007

Related U.S. Application Data

(60) Provisional application No. 60/748,527, filed on Dec. 7, 2005.

(51) Int. Cl.
*B65H 19/14* (2006.01)

(52) U.S. Cl. ..... 242/552; 226/118.2

(58) Field of Classification Search ..... 242/552, 242/554, 416, 417, 417.2, 417.3; 226/36, 226/118.1, 118.2, 113, 189, 195
See application file for complete search history.

(56) References Cited

U.S. PATENT DOCUMENTS

| | | | | |
|---|---|---|---|---|
| 3,278,100 | A * | 10/1966 | Hornberger | |
| 3,743,153 | A * | 7/1973 | Moss | |
| 4,009,814 | A | 3/1977 | Singh | |
| 4,223,822 | A * | 9/1980 | Clitheroe | |
| 4,325,519 | A * | 4/1982 | McLean | |
| 4,723,698 | A | 2/1988 | Schoonderbeek | |
| 5,050,812 | A * | 9/1991 | Mueller | 242/552 |
| 5,190,234 | A * | 3/1993 | Ezekiel | 242/552 |
| 6,785,937 | B2 | 9/2004 | Morman et al. | |
| 2005/0098677 | A1 * | 5/2005 | Hirata et al. | 242/552 |
| 2006/0141888 | A1 | 6/2006 | Morman | |

FOREIGN PATENT DOCUMENTS

| | | |
|---|---|---|
| DE | 33 27 636 A1 | 2/1985 |

(Continued)

OTHER PUBLICATIONS

Roisum, David R., "Flattening," *The Mechanics of Web Handling*, Tappi Press, Atlanta, GA, 1998, p. 154.

*Primary Examiner*—William A Rivera
(74) *Attorney, Agent, or Firm*—David J. Arteman

(57) ABSTRACT

A method of accumulating a web includes pivoting subsets of rolls to a generally vertical alignment; moving one set of rolls past the other; passing the web between the sets of rolls; moving one set of rolls past the other to engage the web; pivoting the subsets to a generally horizontal alignment; moving the web alternatively between the subsets; and moving the sets apart to accumulate the web and together to discharge the web.

A web accumulator includes at least two sets of rolls. Each set of rolls has subsets of rolls. The subsets have two consecutive staggered rolls. The accumulator has a web path defined by alternating between subsets of the first set and subsets of the second set.

20 Claims, 8 Drawing Sheets

FOREIGN PATENT DOCUMENTS

| | | |
|---|---|---|
| DE | 42 41 353 A1 | 5/1994 |
| EP | 0 425 715 A1 | 5/1991 |
| EP | 0 761 582 A2 | 3/1997 |
| EP | 0 989 084 A2 | 3/2000 |
| GB | 1 415 079 A | 11/1975 |

* cited by examiner

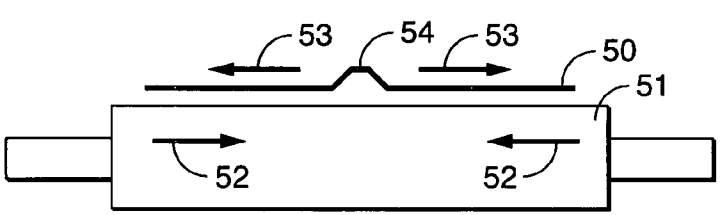
FIG. 3
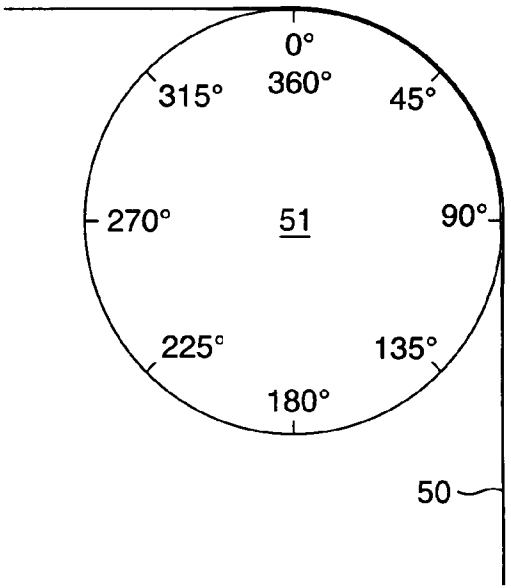
FIG. 4B
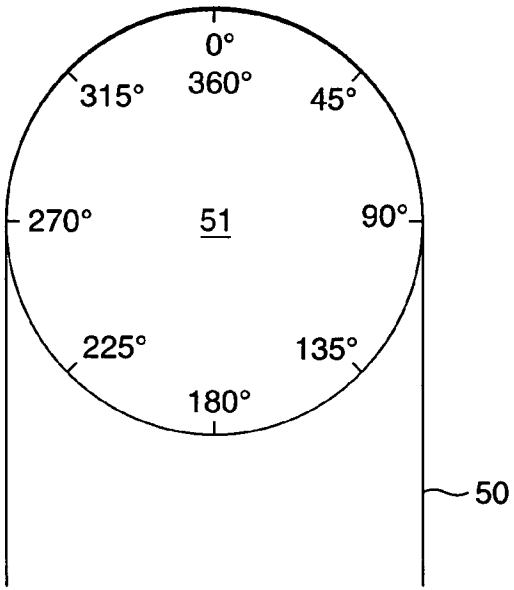
FIG. 4A
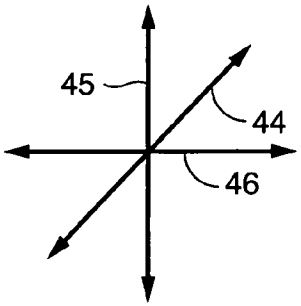
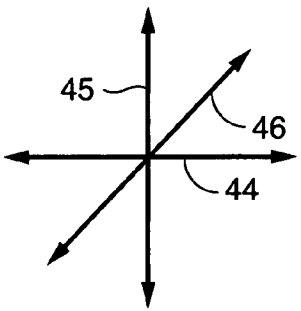

METHOD AND APPARATUS FOR ACCUMULATING A WEB

This application claims priority to provisional application Ser. No. 60/748,527 entitled Method and Apparatus for Accumulating a Web and filed in the U.S. Patent and Trademark Office on Dec. 7, 2005. The entirety of provisional application Ser. No. 60/748,527 is hereby incorporated by reference.

BACKGROUND OF THE INVENTION

The invention relates to web accumulators and methods for accumulating and discharging a reserve portion of a continuous web passing through the accumulator. The invention enables continuous operation of processing stations on either or both sides of the accumulator when the speed of the web moving through the processing stations temporarily varies between the two stations. The invention is particularly useful for handling webs that tend to wrinkle or fold over during processing.

In many processing operations involving continuous lengths of web material, there are temporary differences in operating speeds between two adjacent operating stations. For example, in the manufacture of absorbent articles, it is common to unwind raw materials from large supply rolls and conduct them into a converting operation. In such operations, it is desirable to unwind subsequent supply rolls without shutting down the converting operation. The operation is desirably maintained by splicing a new supply web to the end of the expiring supply web. This would require stopping the converting operation unless a reserve portion of the expiring web had been accumulated for continued operation while a new supply roll is prepared. This problem is quite old and is generally solved through the use of web accumulators.

The typical accumulator for such use is the festooning type. Festooning type accumulators typically consist of a set of fixed web rolls and a set of movable web rolls which are moved away from the fixed rolls for accumulating a reserve portion of the web and moved toward the fixed rolls for discharging the accumulated reserve portion of the web.

The web is typically looped alternately from a roll of the first set to a roll of the second set in consecutive order. In these configurations, there is typically about 180 degrees of wrap contact between the rolls and the web to maximize the capacity of the accumulator relative to the length. This configuration generally results in significant tractional forces between the web and the rolls and may not be suitable for webs having extensibility in the cross-machine direction (CD extensible webs) because of wrinkling.

It is also known through prior joint development to accumulate webs having machine direction extensibility (MD extensible webs) by running at tensions below 0.05 pounds per lineal inch of web. The MD extensible web is susceptible to clinging and wrapping as the web passes from one set of rolls to the other set, at least in part, because of the low tension. To address this issue, the spacing between web passes is increased relative to conventional accumulators. To increase the spacing between web passes, the web is alternately looped from two rolls in the first set to two rolls in the second set in consecutive order and the two rolls are spaced apart in the machine direction by 1 to 2.5 times the diameter of the roll. This configuration results in less than 180 degrees of wrap contact between the rolls and the webs. While designed for accumulating MD extensible webs at very low tensions, this apparatus and method have been used to accumulate other webs at tensions up to 0.15 pounds per lineal inch.

However, there still exists a need for a web accumulator and a method of web accumulation adapted for CD extensible webs.

SUMMARY OF THE INVENTION

In response to the discussed need, the present invention provides a method and apparatus for accumulating and discharging a web. In one aspect, a method includes providing a web to an accumulator; providing a first set of rotatably mounted web rolls comprising at least one subset of rolls linked together and adapted to pivot; providing a second set of rotatably mounted web rolls comprising at least one subset of rolls linked together and adapted to pivot; pivoting the subsets of the first set and the subsets of the second set from a generally horizontal alignment to a generally vertical alignment; moving the second set of rolls past the first set of rolls to define a thread condition; passing the web between the first set of rolls and the second set of rolls; moving the second set of rolls past the first set of rolls to engage the web; pivoting the subsets of the first set and the subsets of the second set from the generally vertical alignment to the generally horizontal alignment to define a run condition; moving the web alternatively between subsets of the first set and subsets of the second set; and moving the second set of rolls away from the first set of rolls to accumulate the web and moving the second set of rolls towards the first set of rolls to discharge the web.

In various embodiments, the web may be extensible in the cross-machine direction. In various embodiments, the web may be elastic slit-necked spunbond.

In various embodiments, the method may further include moving the web with at least 0.075 pounds per lineal inch tension. In various embodiments, the second set of web rolls may be adapted to move vertically past the first set of web rolls when in the thread condition but not in the run condition.

In various embodiments, the method may further include moving the second set of rolls past the first set of rolls by aligning notches in a moveable carriage with portions of a support frame and aligning notches in the support frame with portions of the moveable carriage.

In another aspect, a web accumulator includes at least one first set and at least one second set of rotatably mounted web rolls. The accumulator has a thread condition and a run condition and the second set of web rolls are adapted to move past the first set of web rolls in the thread condition but not in the run condition.

In various embodiments, the first set of web rolls and the second, set of web rolls may have a diameter and may include subsets of rolls. The subsets of rolls may include two rolls per subset and the subsets may have a spacing less than one times the diameter.

In various embodiments, the first set of rolls and the second set of rolls may include carbon fiber and may have sleeves comprising fluoropolymer resins, clear epoxy coatings, nylon, or ultra high molecular weight polymers.

In various embodiments, the first set rolls may be rotatably mounted to a fixed support structure and the second set of rolls may be rotatably mounted to a moveable carriage. The moveable carriage may include notches adapted to align with portions of the support structure and the fixed support structure may include notches adapted to align with portions of the moveable carriage.

In various embodiments, the at least one of the first and second web sets may include at least two consecutive rolls linked together and adapted to pivot between a thread condition and a run condition. In various embodiments, the at least two consecutive rolls may be staggered in the run condition. In various embodiments, the at least two consecutive rolls may be generally aligned in a machine direction in the run condition and generally aligned in a vertical direction in the thread condition.

In various embodiments, the first set and the second set of rolls may have a diameter and include subsets of rolls having two rolls per subset. The subsets may have a spacing less than one times the diameter.

In another aspect, a web accumulator includes at least one first set of rolls. The first set of rolls has at least one subset which has two consecutive staggered rolls. The web accumulator also includes at least one second set of rolls. The second set of rolls has at least one subset which has two consecutive staggered rolls. The second set of rolls may be adapted to move relative to the first set of rolls. The web accumulator also has a web path defined by the two consecutive staggered rolls of the first set followed by the two consecutive staggered rolls of the second set.

In various embodiments, the first set of rolls may include three or more subsets having two consecutive staggered rolls. The second set of rolls may have three or more subsets having two consecutive staggered rolls. The web path may be adapted to sequentially alternate between subsets in the first set and subsets in the second set.

In various embodiments, the staggered rolls may be overlapped in a machine direction. In various embodiments, the subsets may have a first roll and a second roll. The second roll may have a wrap contact angle and the first roll may have a wrap contact angle less than the wrap contact angle of the second roll. In various embodiments, the contact angle of the first roll may be no greater than 60 degrees and the contact angle of the second roll may be no less than 120 degrees.

BRIEF DESCRIPTION OF THE DRAWINGS

FIG. 3 representatively illustrates a cross-sectional view of an exemplary web passing over an exemplary roll.

FIG. 4*a* representatively illustrates a cross-sectional view of a first exemplary wrap contact angle.

FIG. 4*b* representatively illustrates a cross-sectional view of a second exemplary wrap contact angle.

DETAILED DESCRIPTION OF THE DRAWINGS

Figure 1:
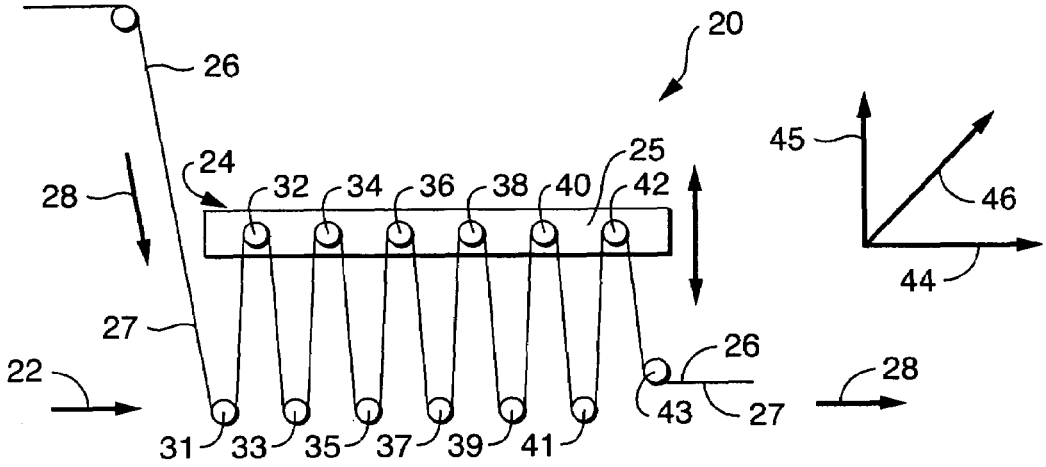
FIG. 1 representatively illustrates a schematic side view of a web accumulator in a run condition.

Referring to FIG. 1, a festooning type accumulator is shown generally at 20. The accumulator 20 is shown in a run condition and includes a first set of rotatably mounted web rolls 22 which includes rolls 31, 33, 35, 37, 39, 41 and 43, and a second set of rotatably mounted web rolls 24 which includes rolls 32, 34, 36, 38, 40, and 42. The second set of web rolls 24 are moveable in a vertical direction 45 towards and away from the first set of web rolls 22 which are fixed in the vertical direction 45. A web 26 moves along a web path 27 in a direction 28 generally in a machine direction 44. Perpendicular to the vertical direction 45 and the machine direction 44 is the cross-machine direction 46. The web 26 is looped alternately from a roll of the first set 22 to a roll of the second set 23 in consecutive order. In FIG. 1, the web 26 moves along the web path 27 in the direction 28 passing from roll to roll in the following order: 31, 32, 33, 34, 35, 36, 37, 38, 39, 40, 41, 42, and 43, before exiting the accumulator 20.

The movable second set of web rolls 24 may be joined to a single carriage 25. The carriage 25 may be moved away from the fixed first set of web rolls 22 for accumulating a reserved portion of the web 26 and moved toward the fixed first set of web rolls 22 for discharging the accumulated reserve portion of the web 26.

As used herein, the term "set" describes a group of rotatably mounted web rolls wherein each web roll remains in the same position relative to the other web rolls within the same group in the run condition. For example, three rolls mounted to a single moveable carriage are in the same set because they remain in the same position relative to each other in the run condition even as the carriage moves. In another example, five fixed position rotatably mounted web rolls are in the same set because they remain in the same position relative to the other web rolls within the same group in the run condition.

As used herein, the term "web path" describes the route by which one or more substrates are adapted to move through a processing module, such as, for example, a web accumulator.

Figure 2:
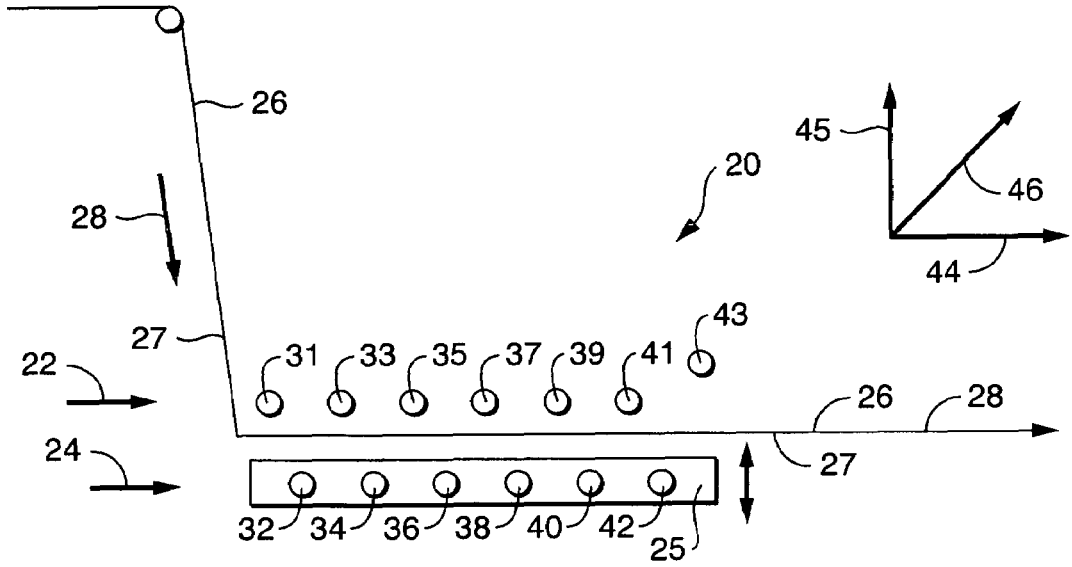
FIG. 2 representatively illustrates a schematic side view of the web accumulator of FIG. 1 in a thread condition.

Referring now to FIG. 2, the accumulator 20 of FIG. 1 is shown in a thread condition wherein, the second set of web rolls 24 has been moved in the vertical direction 45 past the first set of web rolls 22 to allow the web 26 to pass directly through the accumulator 20 without wrapping about the various rolls. The second set of web rolls 24 may then be moved in the vertical direction 45 to engage the various rolls resulting in the configuration illustrated in FIG. 1. This is referred to herein as "pass through threading."

While not wishing to be bound by theory, it is believed that webs moving over rolls are subject to at least two forces: tractional forces and flattening forces. Referring now to FIG. 3, a cross-sectional view of an exemplary web 50 passing over an exemplary roll 51 is illustrated. The roll 51 is axially oriented in the cross-machine direction 46 and the web 50 is moving generally in the machine direction 44. The web 50 is believed to be subjected to tractional forces generally in the direction illustrated by arrows 52 and flattening forces generally in the direction illustrated by arrows 53. When the web 50 comprises materials that are relatively stiff in the cross-machine direction 46, the flattening forces 53 and tractional forces 52 are believed to have little effect on the flatness of the web 50. However, when the web 50 comprises materials having less rigidity in the cross-machine direction 46, the tractional forces 52 and flattening forces 53 are believed to have a greater effect on the web 50. As such, if tractional forces 52 are greater than flattening forces 53, then the web 50 may be more likely to wrinkle in the machine direction 44. If the flattening forces 53 are greater than the tractional forces 52, then the web 50 may be more likely to remain unwrinkled. The present invention provides a compressed apparatus and a method for accumulating a tensioned CD extensible web that reduces the degree of wrap contact and the surface friction, which is believed to reduce tractional forces 52, thereby minimizing the likelihood of wrinkles forming in the web 50.

As used herein, the terms "degree of wrap contact" or "wrap contact"describe the amount of roll circumference that is in contact with a web moving over the surface of the roll. FIGS. 4*a* and 4*b* are alternative cross-sectional views of an exemplary web 50 passing over an exemplary roll 51. The roll 51 can be visualized as having 360 degrees of roll circumference available for wrap contact with the passing web 50 when viewed in cross-section. The web 50 illustrated in FIG. 4*a* contacts the roll 51 at the 270 degree point and ends contact at the 90 degree point thereby having 180 degrees of wrap contact. Whereas, the web 50 illustrated in FIG. 4*b* contacts the roll 51 at the 0 degree point and ends contact at the 90 degree point thereby having 90 degrees of wrap contact. Therefore, the web 50 of FIG. 4*b* has less degrees of wrap contact as compared to the web 50 of FIG. 4*a* and would be expected to have less tractional force acting upon it, other considerations being equal. As such, it is more likely that flattening forces would allow the web 50 to slide on the roll face into a flat condition as it passes over the roll 51.

Figure 5:
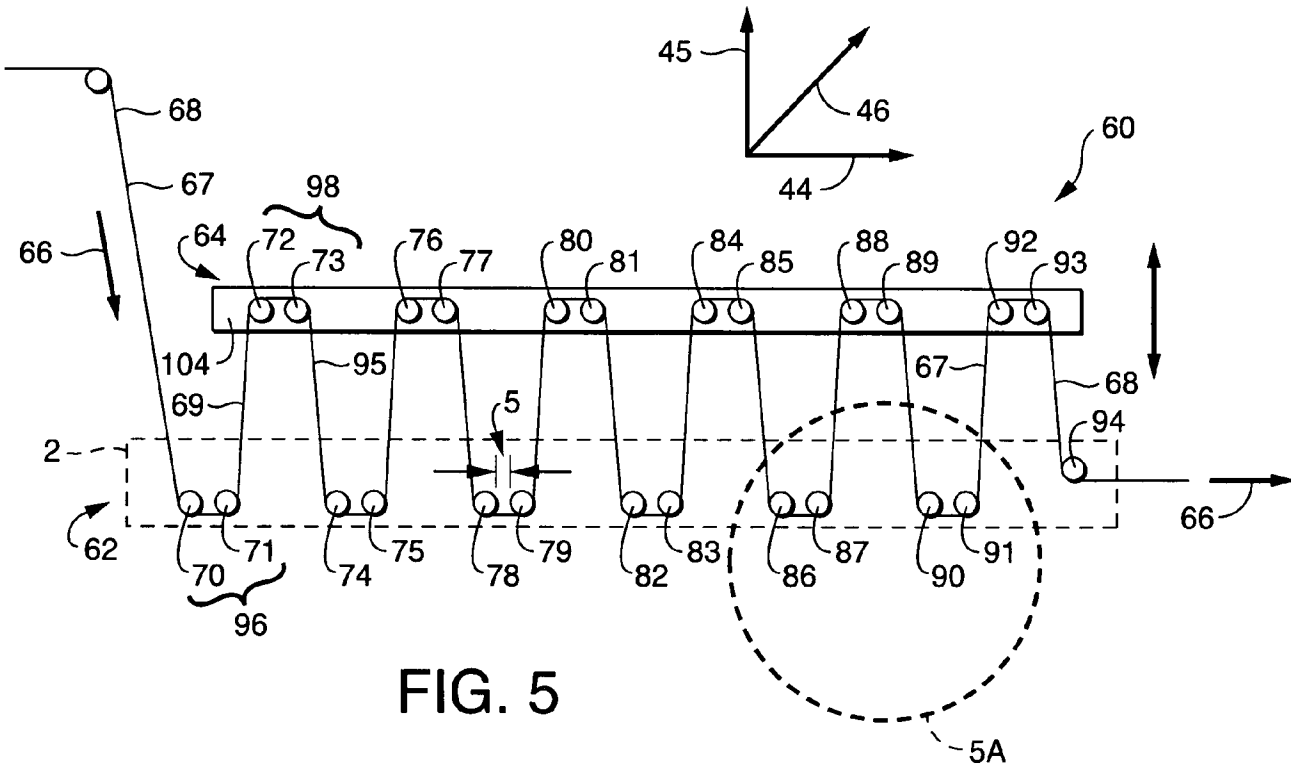
FIG. 5 representatively illustrates a schematic side view of a web accumulator in a run condition.

Referring now to FIG. 5, a side schematic view of a web accumulator in a run condition is illustrated generally at 60. The accumulator 60 includes a first set of rotatably mounted web rolls 62, a second set of rotatably mounted web rolls 64 and a web path 67. A web 68 moves along the web path 67 in the direction 66 generally in a machine direction 44. Perpendicular to the machine direction 44 is a vertical direction 45 and a cross-machine direction 46. The web 68 is looped alternately from two consecutive web rolls in the first set of web rolls 62 to two consecutive web rolls in the second set of web rolls 64 to define the web path 67 through the accumulator 60. The web path 67, in this illustrated embodiment, is adapted such that the web 68 has approximately 90 degrees of wrap or less than 110 degrees of wrap contact with any given roll in the accumulator 60 and each roll of the first set 62 and the second set 64 is adapted to form part of the web path 67.

As illustrated in FIG. 5, the first set of web rolls 62 includes rolls 70, 71, 74, 75, 78, 79, 82, 83, 86, 87, 90, 91 and 94. The second set of web rolls 64 includes rolls 72, 73, 76, 77, 80, 81, 84, 85, 88, 89, 92 and 93. The web 68 moves along the web path 67 in the direction 66 passing from roll to roll in the following order: 70, 71, 72, 73, 74, 75, 76, 77, 78, 79, 80, 81, 82, 83, 84, 85, 86, 87, 88, 89, 90, 91, 92, 93, and 94 before exiting the accumulator 60. Each roll in each set is adapted to form part of the web path 67. As used herein, the term "adapted to form part of the web path" describes a roll positioned within the accumulator such that a web moving along the web path will contact the roll.

In FIG. 5, the rolls in each set 62 and 64 are grouped into subsets having two rolls per subset. As used herein, the term "subset" refers to two or more rolls in sequence within a given set of rolls and is defined by the entrance of the web to the accumulator, one or more web passes, the exit of the web from the accumulator, or combinations thereof. A web pass occurs when the web moves between sets of rolls.

For example, in FIG. 5 a first subset 96 includes sequential rolls 70 and 71 and is defined by the entrance of the web 68 into the accumulator 60 and a web pass 69 from the first set of rolls 62 to the second set of rolls 64. Likewise, a second subset 98 includes sequential rolls 72 and 73 and is defined by the web pass 69 and a web pass 95. Therefore, the first set of rolls 62, as illustrated, includes six subsets of rolls and one single roll. Each subset of rolls, as illustrated, includes two rolls. The second set of rolls 64, as illustrated, includes six subsets of rolls and each subset includes two rolls.

Figure 5A:
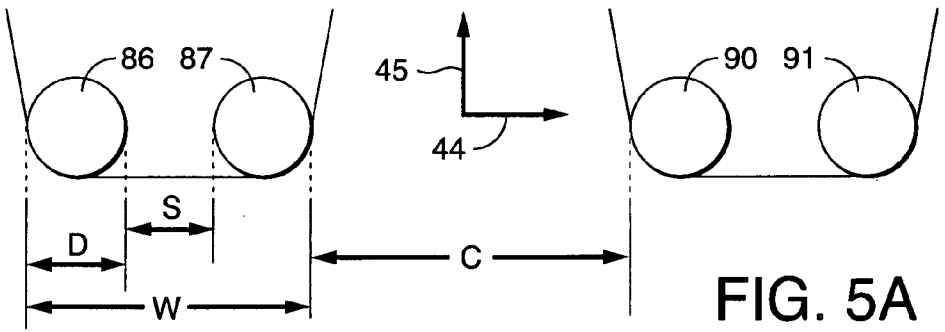
FIG. 5A representatively illustrates a magnified schematic side view of the area designated 5A of the web accumulator of FIG. 5.

FIG. 5A representatively illustrates a magnified schematic side view of the area designated 5A of the web accumulator of FIG. 5. As illustrated in FIG. 5A, the rolls within the subsets have a roll diameter, D, and spacing, S. The spacing, S, is the distance between rolls within a subset. As illustrated, the spacing, S, is about ½ times the roll diameter, D. The subsets have a subset width, W, as measured in the machine direction 44 of approximately 2½ times the roll diameter, D. The subsets are spaced apart from adjacent subsets by a clearance distance, C, as measured in the machine direction 44. The clearance distance, C, as illustrated, is approximately equal to 3½ times the roll diameter, D.

In various embodiments, the subset width W may be less than 3, less than 2½, or less than 2¼ times the roll diameter, D. In various embodiments, the clearance distance, C, may be less than 3½, less than 3, less than 2½, or less than 2¼ times the roll diameter, D. In various embodiments, the spacing, S, may be less than 2, less than 1, less than ½ or less than ¼ times the roll diameter, D.

As illustrated in FIG. 5, the roll diameter, D, the subset width, W, the spacing, S, and the clearance distance, C, are the same in both the first set of rolls 62 and the second set of rolls 64. In various embodiments, the one or more of the roll diameter, D, the subset width, W, the spacing, S, or the clearance distance, C, may be different between subsets and/or between sets.

In FIG. 5, the first set of web rolls 62 may be rotatably mounted to a structure 102 (shown in phantom) that is fixed in position. The second set of web rolls 64 are rotatably mounted to a carriage 104 that is moveable in the vertical direction 45. In various embodiments, the structure 102 or the carriage 104 may be fixed or both may be moveable as long as the first and second sets of rolls can be moved closer together and farther apart in the run condition. The term vertical does not necessarily imply a set direction but a relative direction generally perpendicular to the plane formed by the machine direction and the cross-machine direction.

In FIG. 5, pass through threading is still possible because the second set of web rolls 64 can be moved past the first set of web rolls 62 in the vertical direction 45 in a thread condition and the web 68 may be passed directly through the accumulator 60. In other words, the width, W, of the second set 64 is less than the clearance, C, between subsets of the first set 62.

Figure 6:
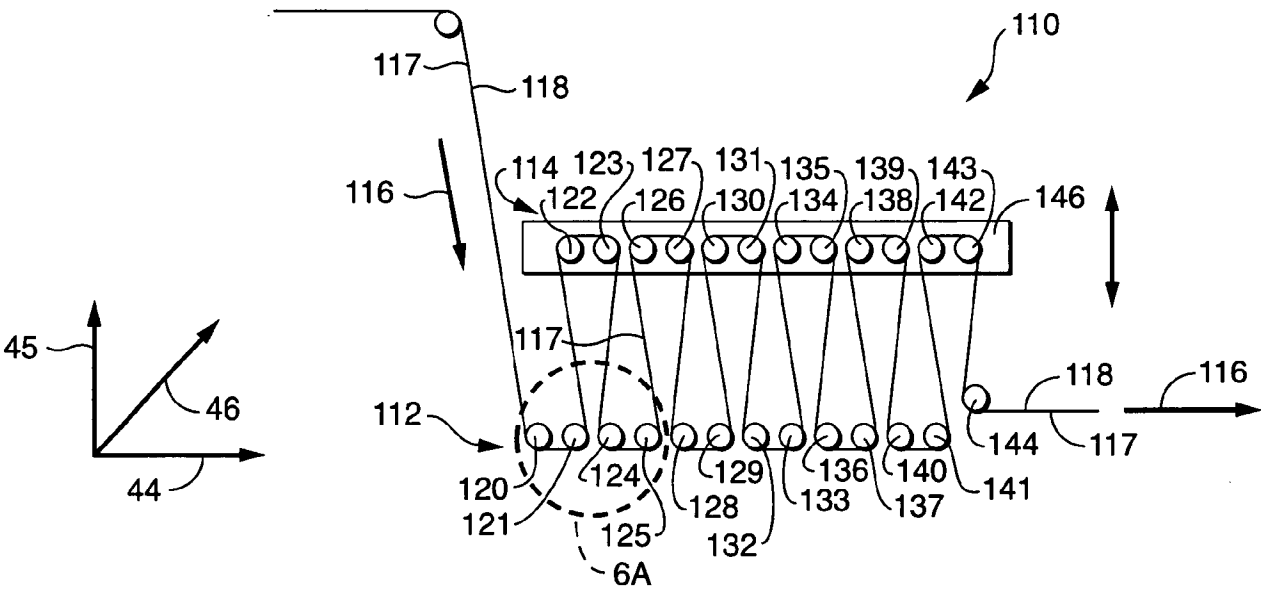
FIG. 6 representatively illustrates a schematic side view of a web accumulator in a run condition.

Referring now to FIG. 6, a schematic side view of a web accumulator in a run condition is illustrated generally at 110. The accumulator 110 includes a first set of rotatably mounted web rolls 112, a second set of rotatably mounted web rolls 114 and a web path 117. A web 118 moves in a direction indicated by arrow 116 generally in a machine direction 44 along the web path 117. Perpendicular to the machine direction 44 is the vertical direction 45 and the cross-machine direction 46. The web 118 is looped alternately from two consecutive web rolls in the first set of web rolls 112 to two consecutive web rolls in the second set of web rolls 114 to define the web path 117 through the accumulator 110. The web path 117, as illustrated, is adapted such that the web 118 has less than 135 degrees of wrap contact with any given roll in the accumulator 110 and each roll is adapted to form part of the web path.

As illustrated in FIG. 6, the first set of web rolls 112 includes rolls 120, 121, 124, 125, 128, 129, 132, 133, 136, 137, 140, 141 and 144. The second set of web rolls 114 includes rolls 122, 123, 126, 127, 130, 131, 134, 135, 138, 139, 142, and 143. The web 118 moves along the web path 117 in the direction 116 passing from roll to roll in the following order: 120, 121, 122, 123, 124, 125, 126, 127, 128, 129, 130, 131, 132, 133, 134, 135, 136, 137, 138, 139, 140, 141, 142, 143, and 144 before exiting the accumulator 110.

In FIG. 6, the first set of web rolls 112 are rotatably mounted and fixed in position and the second set of web rolls 114 are rotatably mounted to a carriage 146 that is moveable generally in the vertical direction 45. In various embodiments, the first set of web rolls 112 may be mounted to a carriage or support structure. In various embodiments either of the first set of rolls 112 or the second set of rolls 114 may be fixed or both may be moveable generally in the vertical direction 45.

Figure 6A:
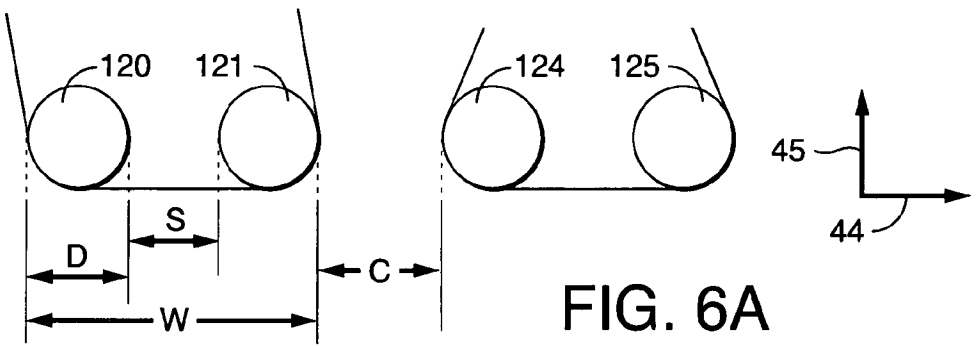
FIG. 6A representatively illustrates a magnified schematic side view of the area designated 6A of the web accumulator of FIG. 6.

FIG. 6A representatively illustrates a magnified schematic side view of the area designated 6A of the web accumulator of FIG. 6. As illustrated in FIG. 6A, the rolls within the subsets have a roll diameter, D, and have a spacing, S, of approximately ½ times the roll diameter, D. Therefore, the subsets have a width, W, as measured in the machine direction 44 of approximately 2½ times the roll diameter, D. The subsets are spaced apart from adjacent subsets by a clearance distance, C, as measured in the machine direction 44. The clearance distance, C, as illustrated, is approximately equal to ½ times the roll diameter, D.

In various embodiments, the clearance distance, C, may be less than 2½, less than 2, less than 1½, less than 1, less than ½, or less than ¼ times the roll diameter, D. In various embodiments, the subset width, W, may be less than 3, less than 2½, or less than 2¼ times the roll diameter, D. In various embodiments, the spacing, S, may be less than 2, less than 1½, less than 1, less than ½, or less than ¼ times the roll diameter, D.

As illustrated in FIG. 6, the roll diameter, D, the subset width, W, the spacing, S, and the clearance distance, C, are the same in both the first set of rolls 112 and the second set of rolls 114. In various embodiments, the one or more of the roll diameter, D, the subset width, W, the spacing, S, or the clearance distance, C, may be different between subsets and/or between sets.

In FIG. 6, pass through threading is not possible because the second set of web rolls 114 can not move past the first set of web rolls 112 in the vertical direction 45 such that the web 118 may be passed directly through the accumulator 110 in a thread condition. In other words, the width, W, of the second set 114 is greater than the clearance, C, between subsets of the first set 112.

Comparing the accumulator 110 of FIG. 6 to the accumulator 60 of FIG. 5, both have 12 web passes utilizing two sets of rolls wherein each set of rolls includes subsets comprising two rolls each. Therefore both accumulators have a similar capacity for accumulating the web. Both accumulators have a similar roll diameter, D, and both accumulators have similar subset width, W. However, the subsets of accumulator 110 of FIG. 6 are spaced more closely together than the subsets of accumulator 60 of FIG. 5. That is, the clearance distance, C, is smaller, and as a consequence the accumulator 110 of FIG. 6 has a smaller footprint. The footprint represents the amount of floor space the accumulator would occupy in a processing operation. In general, it is desirable to minimize the footprint of any given accumulator, while maintaining the necessary accumulating capacity, to minimize the overall space required for the given processing operation being undertaken.

Figure 7:
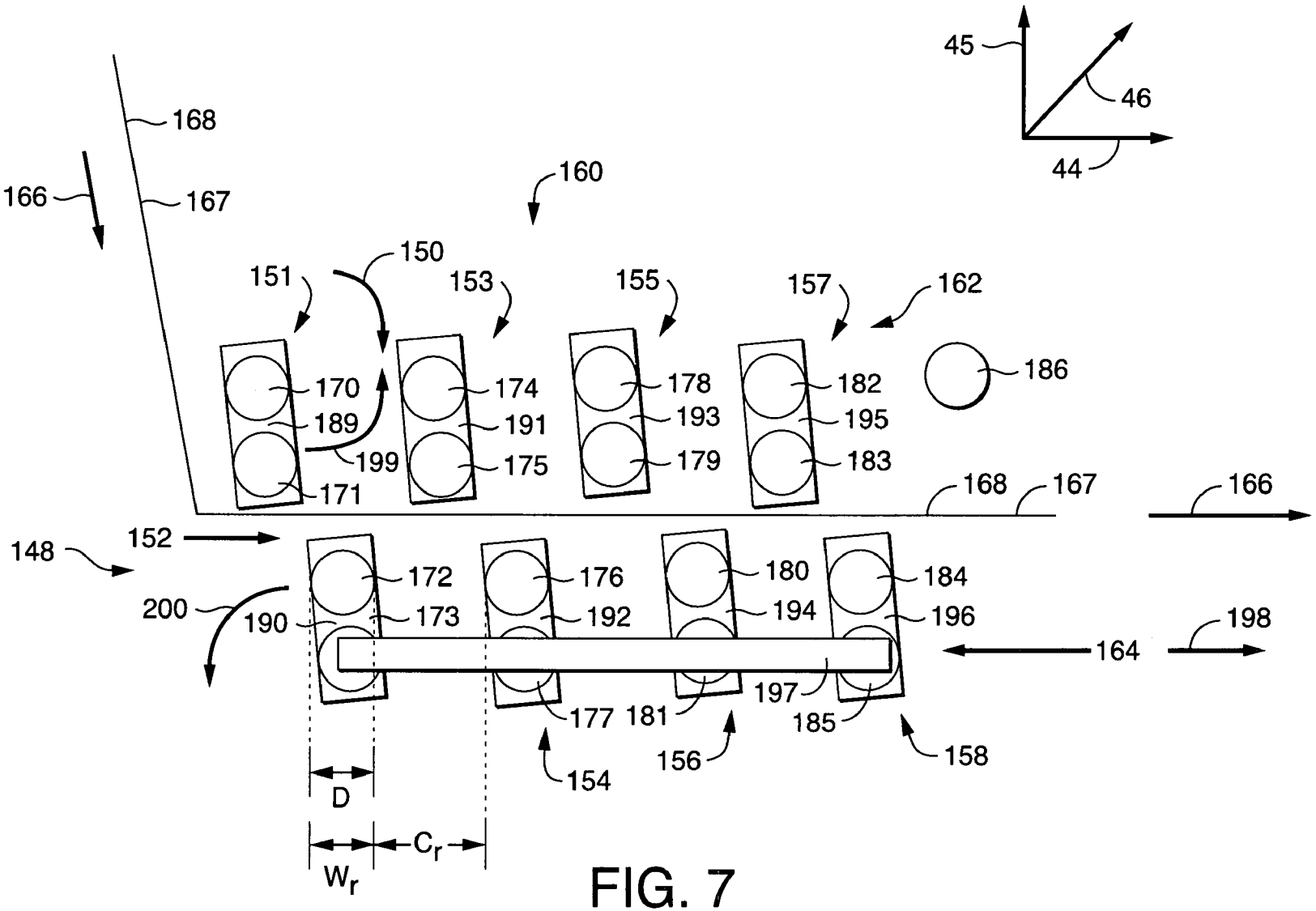
FIG. 7 representatively illustrates a schematic side view of a web accumulator in a thread condition.

Referring now to FIG. 7, an accumulator 160 is illustrated in a thread condition. The accumulator 160 includes a first set of web rolls 162 and a second set of web rolls 164. The first set of web rolls 162 includes rolls 170, 171, 174, 175, 178, 179, 182, 183 and 186. The second set of web rolls 164 includes rolls 172, 173, 176, 177, 180, 181, 184 and 185.

The first set of web rolls 162 includes subsets having two rolls per subset. For example, rolls 170 and 171 comprise a subset 151. Likewise, rolls 174 and 175, 178 and 179, and 182 and 183 comprise subsets 153, 155 and 157 respectively. Each roll in each subset is connected to the other roll in the subset by a linkage. For example, the rolls of subset 151 are connected by a linkage 189. Likewise, the rolls of subsets 153, 155 and 157 are connected by linkages 191, 193 and 195 respectively.

In various embodiments, the first set of web rolls 162 are rotatably mounted to one or more structures. The structures may be a support frame, linkages, a carriage, and the like. The structures may be fixed or may be moveable in a vertical direction 45. In FIG. 7, the first set of web rolls 162 may be rotatably mounted to linkages which in turn are mounted to a support frame or similar structure which is not shown for purposes of clarity. In the thread condition, the rolls making up the subsets are generally aligned in the vertical direction 45. The subsets of the first set 162 are adapted to pivot in the direction indicated by arrow 199 as the accumulator transitions from the thread condition to a run condition.

The second set of web rolls 164 includes subsets having two rolls per subset. For example, rolls 172 and 173 comprise a subset 152. Likewise, rolls 176 and 177, 180 and 181, and 184 and 185 comprise subsets 154, 156 and 158 respectively. The rolls of subsets 151, 153, 155 and 157 are connected by linkages 190, 192, 194 and 196 respectively.

In FIG. 7, the second set of web rolls 164 may be rotatably mounted to linkages which in turn are mounted to a carriage that is moveable in a vertical direction 45 which is not shown for purposes of clarity. In the thread position, the rolls making up the subsets are generally aligned in the vertical direction 45. The subsets of the second set 164 are adapted to pivot in the direction indicated by arrow 200 as the accumulator transitions from the thread condition to the run condition.

In various embodiments, the subsets may pivot in either direction. In various embodiments, one or more first subsets may pivot in a different direction than one or more second subsets within the same set. In various embodiments, only subsets of the first set or only subsets of the second set may be adapted to pivot.

In some embodiments, two or more subsets may be connected by a master linkage which may be adapted to pivot the two or more subsets. In various embodiments, any number of subsets may be controlled with one or more master linkages. In various embodiments, the one or more master linkages may move in any direction suitable to pivot the attached subsets.

For example, subsets 152, 154, 156 and 158, as illustrated, are connected by a master linkage 197 such that movement of the master linkage 197 in the direction indicated by arrow 198 results in each of the subsets 152, 154, 156 and 158 pivoting simultaneously in the direction indicated by the arrow 200. In various embodiments, any number of subsets may be controlled with one or more master linkages.

As illustrated in FIG. 7, the rolls within the subsets have a roll diameter, D, and have a subset width, $W_T$, in the thread condition, as measured in the machine direction 44. Because the rolls within the subsets are generally aligned in the vertical direction 45, the roll diameter, D, and the subset width, $W_T$, are nearly equal. In some embodiments, the roll diameter, D, and the subset width, $W_T$, may be equal. The subsets are spaced apart from adjacent subsets by a clearance distance, $C_T$, in the thread condition, as measured in the machine direction 44. As illustrated, the clearance distance, $C_T$, is approximately two times the roll diameter, D. Because the clearance distance, $C_T$, is greater than the thread width, $W_T$, the second set of web rolls 164 are adapted to pass the first set of web rolls 162 in the thread condition. This adaptation permits the web 168 to be threaded through the accumulator on path 167 without wrapping the web 168 about the various rolls such as is illustrated in FIG. 7.

As illustrated in FIG. 7, the roll diameter, D, the spacing, S, the subset width, $W_T$, and the clearance distance, $C_T$, are the same in both the first set of rolls 62 and the second set of rolls 64. In various embodiments, one or more of the roll diameter, D, the subset width, $W_T$, the spacing, S, or the clearance distance, $C_T$, may be different between subsets and/or between sets.

After threading the web 168 through the accumulator 160, the second set of rolls 164 are adapted to move vertically past the first set of rolls 162 to engage the web 168. After the second set of rolls 164 engages the web 168 and clears the first set of rolls 162 the first set of rolls 162 are adapted to pivot in the direction 199 and the second set of rolls 164 are adapted to pivot in the direction 200 thereby transitioning the accumulator 160 into a run condition as illustrated in FIG. 8.

Figure 8:
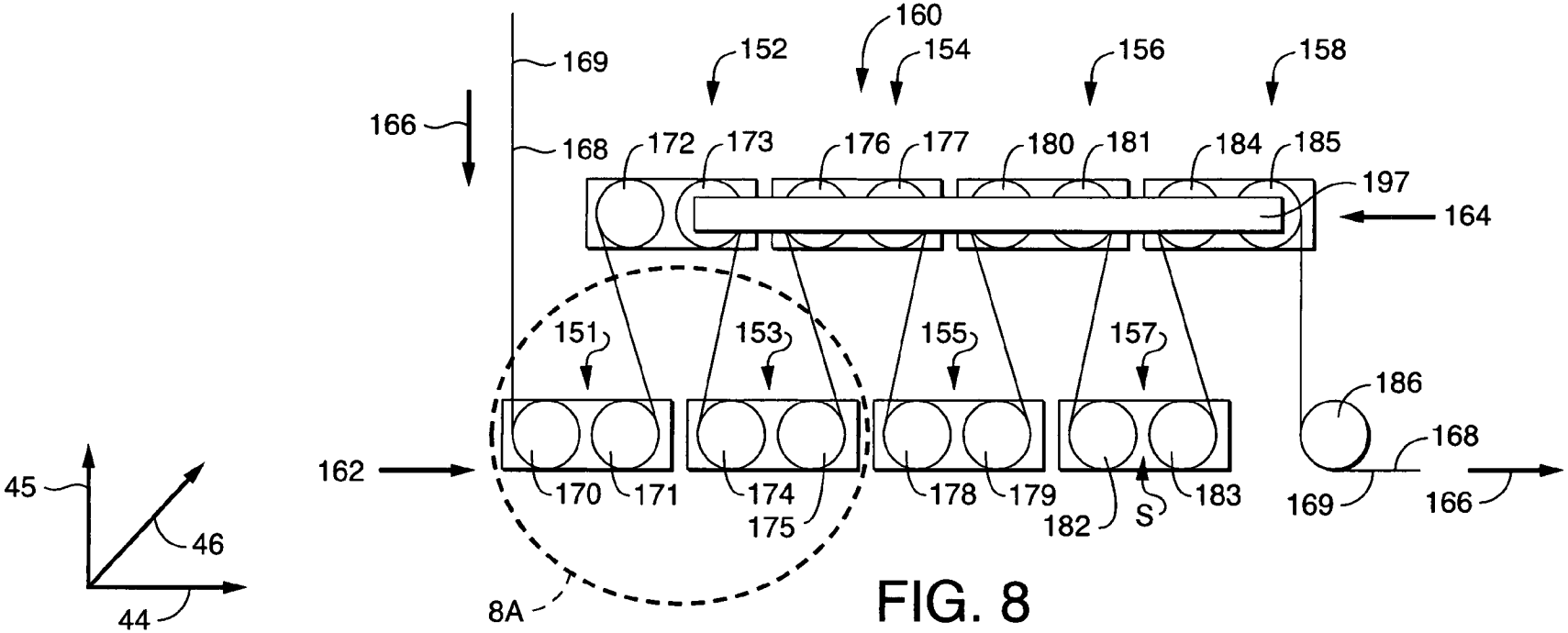
FIG. 8 representatively illustrates a schematic side view of the web accumulator of FIG. 7 in a run condition.

Referring now to FIG. 8, a side view of the web accumulator 110 of FIG. 7 is illustrated in the run condition. The accumulator 160 includes the first set of rotatably mounted web rolls 162 and the second set of rotatably mounted web rolls 164. The web path 167 of FIG. 7 has transitioned to a new web path 169 in the run condition as illustrated in FIG. 8. The subsets 151-158 of FIG. 7 have been pivoted from alignment generally in the vertical direction 45 to alignment generally in the machine direction 44. Pivoting the subsets 151-158 completes the transition of the accumulator 110 from the thread condition to the run condition.

The web 168 moves in a direction indicated by arrow 166 generally in a machine direction 44 along the web path 169. The web 168 is looped alternately from a subset, including two consecutive web rolls, in the first set of web rolls 162 to a subset, including two consecutive web rolls, in the second set of web rolls 164 to define the web path 169 through the accumulator 160. The web path 169, as illustrated, is adapted such that the web 168 has less than 135 degrees of wrap contact with any given roll in the accumulator 160 in the run condition and each roll is adapted to form part of the web path.

The web 168 moves along the web path 169 in the direction 166 passing from roll to roll in the following order: 170, 171, 172, 173, 174,175, 176, 177, 178, 179, 180, 181, 182, 183, 184, 185, and 186 before exiting the accumulator 160.

Figure 8A:
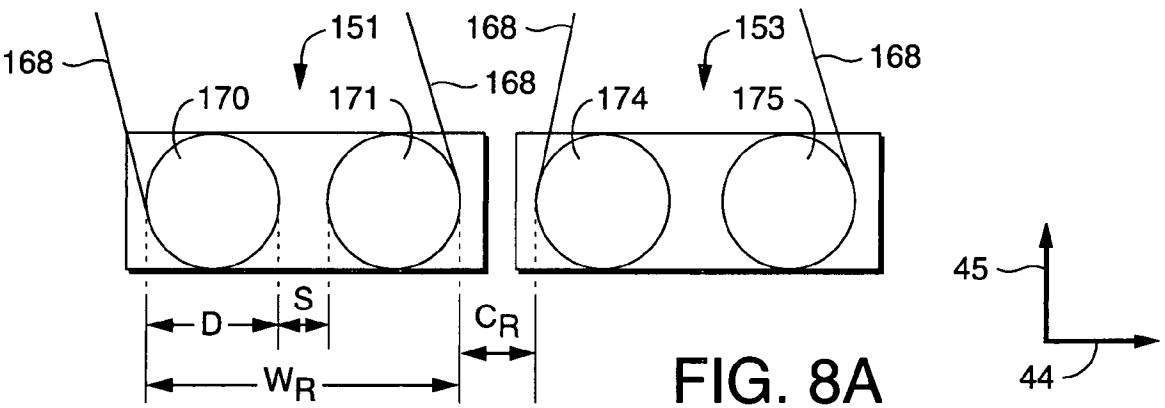
FIG. 8A representatively illustrates a magnified schematic side view of the area designated 8A of the web accumulator of FIG. 8.

FIG. 8A representatively illustrates a magnified schematic side view of the area designated 8A of the web accumulator of FIG. 8. As illustrated in FIG. 8A, the rolls within the subsets have a roll diameter, D, and a spacing, S, of approximately ¼ times the roll diameter, D. The subsets also have a width, $W_R$, in the run condition, as measured in the machine direction 44. Because the rolls within the subsets are now generally aligned in the machine direction 44, the subset width, $W_R$, is approximately 2¼ times the roll diameter, D. The subsets are now spaced apart from adjacent subsets by a clearance distance, $C_R$, in the run condition, as measured in the machine direction 44. As illustrated, the clearance distance, $C_R$, is approximately ½ times the roll diameter, D. In the run condition, the clearance distance, $C_R$, of the first set 162 is less than the subset width, $W_R$, of the second set 164. Therefore, the second set 164 is not able to pass the first set 162 in the run condition.

Figure 9:
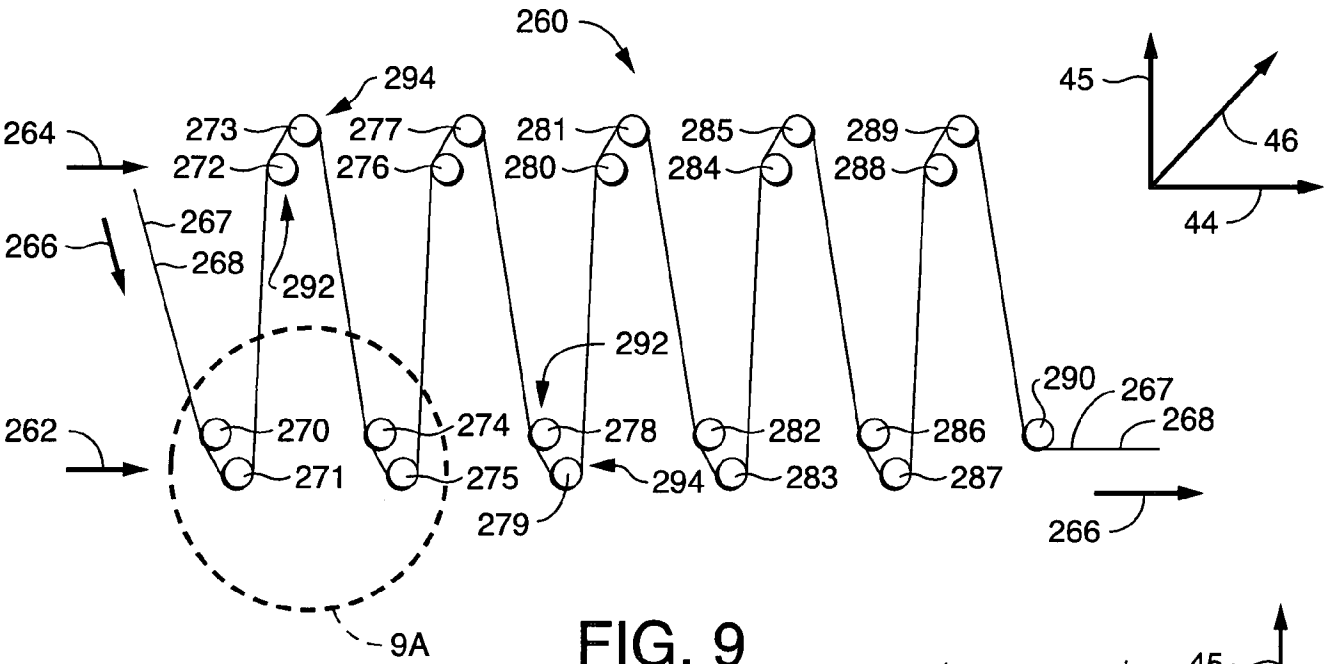
FIG. 9 representatively illustrates a schematic side view of a web accumulator in a run condition.

Optionally, the subsets of this embodiment may be only partly pivoted in the run mode thereby resulting in a staggered configuration similar to that illustrated in FIG. 9. As such, the subset width, $W_R$, may be less than 2, less than 1¾, less than 1½, or less than 1¼ times the roll diameter, D. At one times the roll diameter, D, the rolls would be vertically aligned and would not benefit from the reduced contact angle as disclosed herein. In various embodiments, the clearance, C, need only be greater than the subset width, $W_T$, in the thread condition to allow through threading. In various embodiments, the spacing, S, may be less than 1, less than ½, or less than ¼ times the roll diameter, D.

As illustrated in FIG. 8, the roll diameter, D, the spacing, S, the subset width, $W_R$, and the clearance distance, $C_R$, are the same in both the first set of rolls 62 and the second set of rolls 64. In various embodiments, one or more of the roll diameter, D, the subset width, $W_R$, the spacing, S, or the clearance distance, $C_R$, may be different between subsets and/or between sets.

Comparing the accumulator 160 of FIGS. 7 and 8 to the accumulator 60 of FIG. 5, both have reduced wrap angle but the accumulator 160 has a compressed footprint, similar to the accumulator 110 of FIG. 6.

Referring now to FIG. 9, a schematic side view of a web accumulator in a run condition is illustrated generally at 260. The accumulator 260 includes a first set of rotatably mounted web rolls 262, a second set of rotatably mounted web rolls 264 and a web path 267. A web 268 moves in a direction indicated by arrow 266 generally in a machine direction 44 along the web path 267. Perpendicular to the machine direction 44 is the vertical direction 45 and the cross-machine direction 46. The web 268 is looped alternately from two consecutive web rolls in the first set of web rolls 262 to two consecutive web rolls in the second set of web rolls 264 to define the web path 267 through the accumulator 260. The web path 267, as illustrated, is adapted such that the web 268 has less than 180 degrees of wrap contact with any given roll in the accumulator 260 and each roll is adapted to form part of the web path.

As illustrated in FIG. 9, the first set of web rolls 262 includes rolls 270, 271, 274, 274, 278, 279, 282, 283, 286, 287, and 290. The second set of web rolls 264 includes rolls 272, 273, 276, 277, 280, 281, 284, 285, 288, and 289. The web 268 moves along the web path 267 in the direction 266 passing from roll to roll in the following order: 270, 271, 272, 273, 274, 275, 276, 277, 278, 279, 280, 281, 282, 283, 284, 285, 286, 287, 288, 289, and 290 before exiting the accumulator 260.

In FIG. 9, the first set of web rolls 262 are rotatably mounted and may be fixed in position and the second set of web rolls 264 are rotatably mounted and may be fixed to a carriage that is moveable generally in the vertical direction 45. In various embodiments, the first set of web rolls 262 may be mounted to a carriage or support structure. In various embodiments either the first set 262 or the second set 264 may be fixed or both may be moveable generally in the vertical direction 45.

In FIG. 9, pass through threading is possible because the second set of web rolls 264 can move past the first set of web rolls 262 in the vertical direction 45 such that the web 268 may be passed directly through the accumulator 260 in a thread condition. In other words, the width, W, of the second set 264 is less than the clearance, C, between subsets of the first set 262.

Figure 9A:
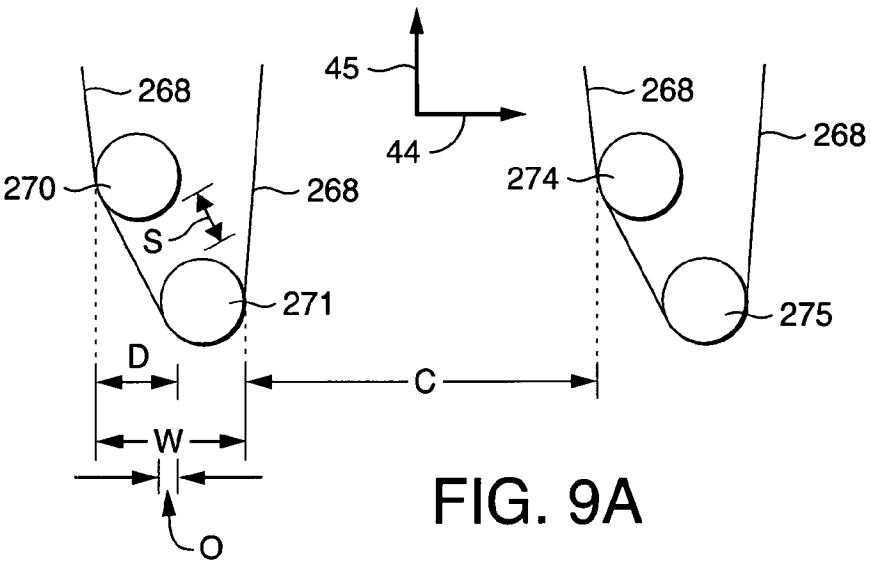
FIG. 9A representatively illustrates a magnified schematic side view of the area designated 9A of the web accumulator of FIG. 9.

FIG. 9A representatively illustrates a magnified schematic side view of the area designated 9A of the web accumulator of FIG. 9. As illustrated in FIG. 9, the rolls within the subsets have a roll diameter, D, and a spacing, S, that is approximately ½ times the roll diameter, D. The rolls within the subsets are staggered relative to the other roll in the subset. As used herein, the term "staggered" refers to rolls aligned in a plane other than the plane defined by the machine direction 44 and the cross-machine direction 46. Staggered rolls may have an overlap, O, wherein a portion of one roll is located vertically above a portion of the other roll in the subset. As illustrated in FIG. 9A, the rolls have an overlap, O, of approximately ¼ times the roll diameter, D. The subsets have a width, W, as measured in the machine direction 44, of approximately 1¾ times the roll diameter, D. The subsets are spaced apart from adjacent subsets by a, clearance distance, C, as measured in the machine direction 44. The clearance distance, C, as illustrated, is approximately equal to four times the roll diameter, D.

In various embodiments, the subset width, W, may be less than 2, less than 1¾, less than 1½, or less than 1¼ times the roll diameter, D. At one times the roll diameter, D, the rolls would be vertically aligned and would not benefit from the reduced contact angle as disclosed herein.

In various embodiments, the clearance, C, may be less than 4, less than 3, less than 2, less than 1¾, or less than 1½ times the roll diameter, D. To provide through threading, the clearance, C, should be greater than the subset width, W, in the thread condition. However, if through threading is not desired, the clearance, C, may be equal to or less than the subset width, W, in the thread condition.

In various embodiments, the spacing, S, may be less than 1, less than ½, or less than ¼ times the roll diameter, D. In various embodiments, there may be staggered rolls having no overlap, O. In other embodiments, the overlap, O, may be at least ¼, ½ or ¾ times the roll diameter, D.

As illustrated in FIG. 9, the roll diameter, D, the spacing, S, the subset width, W, the overlap, O, and the clearance distance, C, are the same in both the first set of rolls 262 and the second set of rolls 264. In various embodiments, one or more of the roll diameter, D, the subset width, W, the spacing, S, the overlap, O, or the clearance distance, C, may be different between subsets and/or between sets.

In various embodiments, the accumulators described herein may have at least one first set of rolls and at least one second set of rolls. In some embodiments, the accumulator may have 3, 4, 5, 6, 7, or more than 8 sets of rolls. In various embodiments, the web path may alternate between at least two rolls of a first set and at least two rolls of a second set.

In various embodiments, the accumulators described herein may include one or more rolls having less than 180, less than 135, or less than 100 degrees of wrap contact. In some embodiments, one or more rolls may have about 90 degrees of wrap contact. In some embodiments, at least 3, 4, 5, 6, 7, 8, 9 or 10 rolls have a wrap contact less than 100, 120, 135, 140, 160, or 180 degrees.

In various embodiments, the accumulators described herein may include one or more sets of rolls having one or more subsets of rolls. For example, one or more sets of rolls may include 1, 2, 3, 4, 5, 6, 7, 8, 9, 10 or more than 10 subsets. In various embodiments, a subset of rolls may include 2, 3, 4, 5 or more than 5 rolls. In various embodiments, one or more sets of rolls may include one or more subsets of rolls and may also include one or more single rolls that are part of the set but are not part of a subset. In various embodiments, one or more sets of rolls may include two or more subsets of rolls wherein the subsets have a different number of rolls. For example, a set of rolls may include two subsets wherein the first subset has two rolls and the second subset has three rolls.

In various embodiments, the accumulators described herein may include a web path that moves from a first subset of rolls in the first set to a first subset of rolls in the second set to a second subset of rolls in the first set to a second subset of rolls in the second set continuing to alternate between sets and subsets until the web exits the accumulator. Each time the web leaves a set of rolls and moves to a different set of rolls it makes a web pass. In various embodiments, the accumulator may include at least 1, 2, 3, 4, 5, 6, 7, 8, 9 or 10 web passes. In some embodiments, the accumulator may include more than 10 web passes.

Suitable rolls for use with the accumulators described herein are known in the art. For example, suitable rolls may be purchased from Advanced Composite Products and Technology Incorporated having offices at 15602 Chemical Lane, Huntington Beach, Calif., USA.

The rolls discussed herein may be made of any suitable materials, such as, for example, metal or carbon fiber composites. The rolls discussed herein may include any suitable surfaces, such as, for example, hard anodized finishes, TEFLON® brand fluoropolymer resins, clear epoxy coatings, NYLATRON® brand wear resistant nylon and ultra high molecular weight polymers. The rolls may include any suitable shape, such as, for example, straight, concave or convex. The rolls may be driven or may rotate freely or may include combinations of driven and freely rotatable rolls.

While not wishing to be bound by theory, it is believed that reducing tractional forces by reducing friction in conjunction with reduced wrap contact provides even greater web flattening benefits because propagating wrinkles can slide across the surface of the rolls.

The rolls discussed herein may be any suitable diameter, such as, for example, 0.5 inches (1.27 cm) to 8 inches (20.32 cm). In various embodiments, suitable rolls have a diameter of 1.115 inches (2.8321 cm).

The carriages discussed herein may include any suitable structure and may be moveable via any suitable means, such as, for example, moving on low friction ball bushing shafting. The carriages may include tension applied thereto by any suitable means, such as, for example, air cylinders acting on the carriage.

The sets of rolls discussed herein may be rotatably mounted to support structures such as, for example, carriages, frames, linkages, and the like, and combinations thereof. The support structures may be adapted to allow through threading by removing portions of one or more support structures such that one or more sets of rolls mounted thereto may pass one or more other sets of rolls without interference between the support structures.

Figure 10:
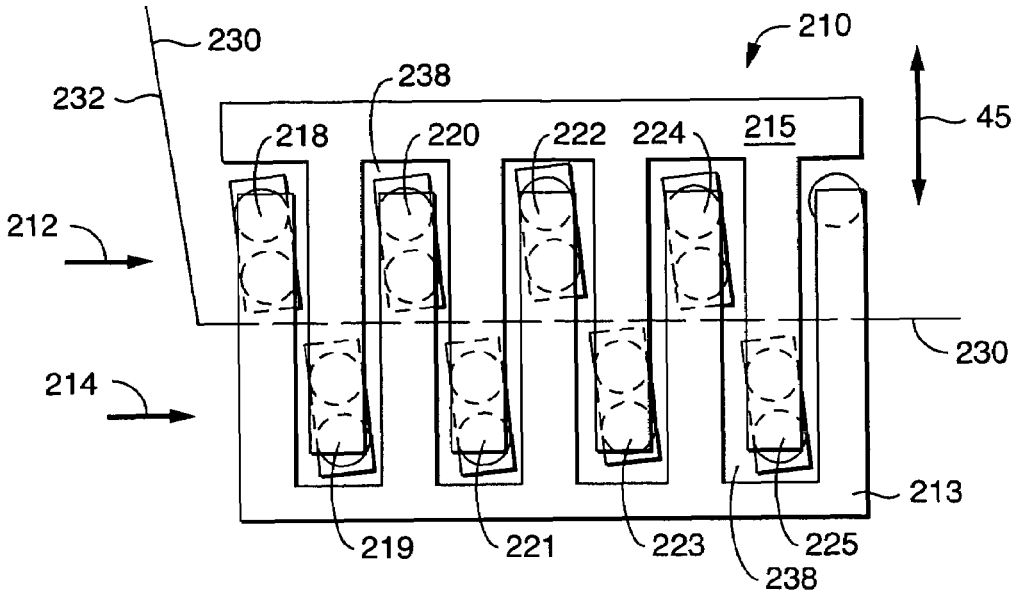
FIG. 10 representatively illustrates a schematic side view of a web accumulator in a thread condition.

For example, in FIG. 10, an accumulator 210 is illustrated in a thread condition and is adapted to allow through threading. The accumulator 210 includes a first set of web rolls 212 and a second set of web rolls 214. The first set of web rolls 212, as illustrated, are rotatably mounted to a fixed support frame 213 via linkages. The second set of web rolls 214, as illustrated, are rotatably mounted via linkages to a carriage 215 that is moveable in a vertical direction 45. The first set of web rolls 212 includes subsets 218, 220, 222 and 224 which comprise two rolls per subset. Each roll in each subset is connected to the other roll in the subset by a linkage. In the thread condition, the rolls making up the subsets are generally aligned in the vertical direction 45. The subsets are adapted to pivot as the accumulator 210 transitions from the thread condition to the run condition. In various embodiments, one or more subsets may pivot in either direction.

The fixed support frame 213 and the vertically movable carriage 215, as illustrated, are adapted such that the second set of rolls 214 can move past the first set of rolls 212 in the thread condition without interference between the frame 213 and the carriage 215. In this embodiment, the frame 213 and the carriage 215 have offset notches 238 that are adapted to allow the second set of rolls 214 to pass below the first set of rolls 212. The method of using the apparatus includes aligning the notches 238 in the carriage 215 with portions of the support frame 213 and aligning the notches 238 in the support frame 213 with portions of the moveable carriage 215. As such, the web 230 can be threaded through the accumulator 210 on the path 232 without wrapping the web 230 about the various rolls.

The generally vertical alignment of the subsets in the thread condition allows for a more compressed accumulator 210 having reduced wrap contact while still allowing for through threading.

After threading the web 230 through the accumulator 210, the second set of rolls 214 are adapted to move vertically past the first set of rolls 212 to engage the web 230. After the second set of rolls 214 engages the web 230 and clears the first set of rolls 212, the first set of rolls 212 and the second set of rolls 214 may be pivoted into alignment generally in the machine direction 44 thereby transitioning the accumulator 210 into a run condition as illustrated in FIG. 11.

Figure 11:
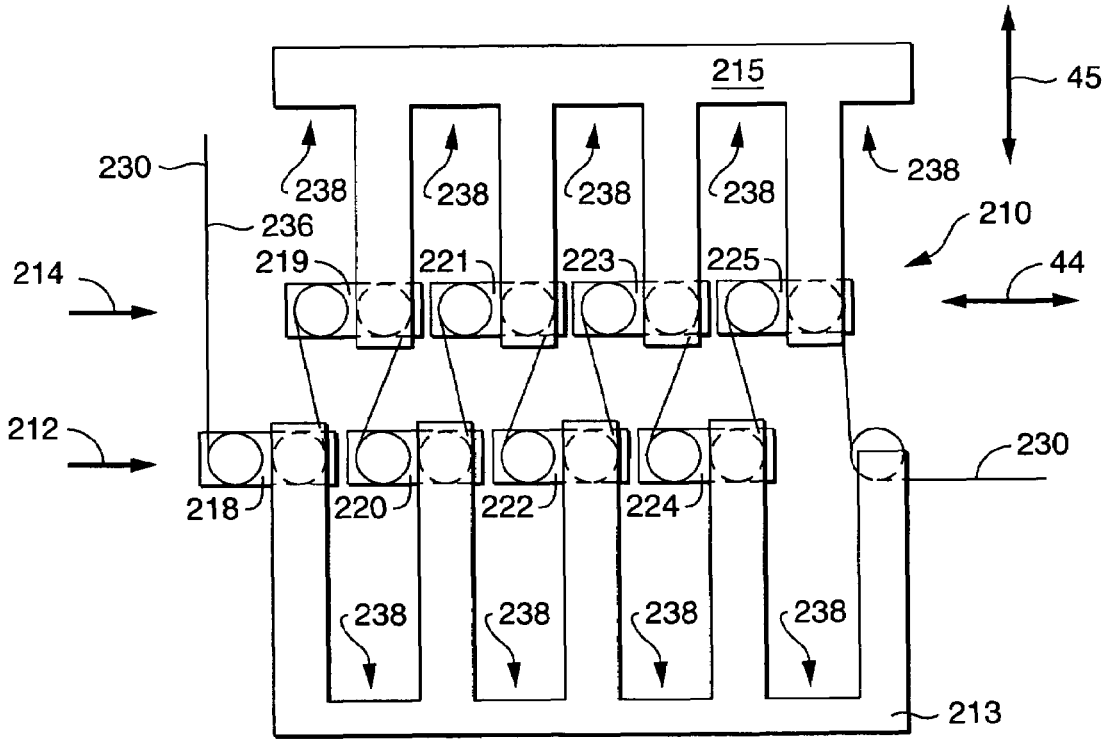
FIG. 11 representatively illustrates a schematic side view of the web accumulator of FIG. 10 in a run condition.

Referring now to FIG. 11, a side view of the web accumulator 210 of FIG. 10 is illustrated in the run condition. The accumulator 210 includes the first set of rotatably mounted web rolls 212 and the second set of rotatably mounted web rolls 214. The web path 232 of FIG. 10 has transitioned to a new web path 236 in the run condition. The subsets 218-225 of FIG. 10 have been pivoted from alignment generally in the vertical direction 45 to alignment generally in the machine direction 44. Pivoting the subsets 218-225 completes the transition of the accumulator 210 from the thread condition illustrated in FIG. 10 to the run condition illustrated in FIG. 11.

The web 230 moves in a direction indicated by arrow 234 along the web path 236. The web 230 travels alternately from two consecutive web rolls in the first set of web rolls 212 to two consecutive web rolls in the second set of web rolls 214 to define the web path 236 through the accumulator 210. The web path 236, as illustrated, is adapted such that the web 230 has less than 135 degrees of wrap contact with any given roll in the accumulator 210 in the run condition. Additionally each roll in each set is adapted to form part of the web path 236. The web 230 moves along the web path 236 in the direction 234 passing from roll to roll before exiting the accumulator 210.

One skilled in the art will readily identify alternative adaptations allowing the second set of rolls 214 to vertically pass the first set of rolls 212. For example, the first set of rolls 212 may be cantilevered from one side whereas the second set of rolls 214 may be cantilevered from the opposite side. As such, the rolls may pass without interference from the supporting structures.

The apparatus and methods described herein may be suitable for use with a wide variety of web materials such as, for example, materials having low rigidity in a cross-machine direction, such as, for example CD extensible webs including CD elastic webs. Suitable CD extensible webs include slit elastic fibrous nonwoven laminates as disclosed in U.S. Pat. No. 5,804,021 issued Sep. 8, 1998 to Abuto et al, the entirety of which is incorporated herein by reference where not contradictory. Other suitable CD extensible webs include neck bonded fibrous nonwoven laminates, slit elastic spunbond laminates, slit-necked spunbond laminates, and the like. Other suitable laminates include those taught in commonly assigned U.S. application Ser. No. 11/021,432 to Morman filed Dec. 23, 2004 and U.S. Pat. No. 6,785,937 to Morman et al. issued Sep. 7, 2004, the entirety of both are incorporated herein in their entirety where not contradictory.

In various embodiments, the webs may have any suitable basis weights. In various embodiments, suitable webs may have basis weights of 10 grams per square meter (gsm) to 110 gsm. In some embodiments, suitable webs may have basis weights of 12-34 gsm. In other embodiments, suitable webs may have basis weights of 20-22 gsm.

The apparatus and methods described herein may be suitable for use with web materials that can be processed under tension in the machine direction. For example, the method described herein may include applying and maintaining tension in the machine direction. In some embodiments, the webs may be moved through the accumulators described herein while maintaining at least 0.6 pounds of tension. In some embodiments, the webs may be moved through the accumulators while maintaining at least 0.075 pounds tension per lineal inch of web. In some embodiments, the webs may be moved through the accumulators while maintaining at least 0.1, 0.2, 0.3, 0.4, 0.5, 0.6 or 0.7 pounds tension per lineal inch of web. In some embodiments, the webs may be moved through the accumulators while maintaining 0.075 to 0.75 pounds tension per lineal inch of web.

The apparatus described herein may be suitably used to accumulate and discharge various webs as described above. One suitable method for using the apparatus depicted in FIG. 5 includes providing a web 68 to the accumulator 60. The accumulator 60 may include a run condition as illustrated and a thread condition (not illustrated). In the thread condition, the second carriage 104, including the second set of rolls 64, may be moved in the vertical direction 45 below the first set of rolls 62. The web 68 may then be passed directly through the accumulator 60 between the first set of rolls 62 and the second set of rolls 64. Once the web is passed through the accumulator 60, the second carriage 104 is moved in the vertical direction 45 past the first set of rolls 62 to engage the web 68 thereby resulting in the web path 67 illustrated in FIG. 5.

The web path 67 is defined by the web 68 being moved in the direction 66 to a first subset of rolls 96 in the first set of rolls 102. The web 68 sequentially contacts rolls 70 and 71 before making a web pass 69 to a second subset of rolls 98. The second subset of rolls 98 includes rolls 72 and 73. The web 68 is moved sequentially in contact with and past the rolls 72 and 73 before making a web pass 95 to roll 74 and roll 75. The web 68 continues to be alternated between two consecutive rolls in the first set of rolls 62 and two consecutive rolls in the second set of rolls 64 and two consecutive rolls in the first set 62 and so forth until the web 68 passes roll 94 and exits the accumulator 60. The web path 67, as illustrated, is adapted such that the web 68 has less than 135 degrees of wrap contact with any given roll 70-94 as the web 68 is moved through the accumulator 60. Each roll is adapted to form a part of the web path 67.

In various embodiments, each roll is adapted to have less than 180, less than 170, less than 160, less than 150, less than 140, less than 130, less than 120 or less than 110 degrees of wrap contact.

One suitable method for using the apparatus depicted in FIG. 6 includes providing a web 118 to the accumulator 110. The accumulator 110 includes a run condition as illustrated. To thread and run the accumulator 110, the web 118 is moved in the direction 66 to a first subset of rolls in the first set of rolls 112. The web 118 sequentially contacts rolls 120 and 121 before making a web pass to rolls 122 and 123 of the second set of rolls 114. The web 118 is moved sequentially past rolls 122 and 123 before being making a web pass to roll 124 and roll 125 of the first set of rolls 112. The web 118 continues to be alternated between two consecutive rolls in the first set of rolls 112 and two consecutive rolls in the second set of rolls 114 until the web passes roll 144 and exits the accumulator 110. The web path 117, as illustrated, is adapted such that the web 118 has less than 135 degrees of wrap contact with any given roll 120-144 as the web 118 is moved through the accumulator 110. Each roll is adapted to form a part of the web path 117.

In various embodiments, each roll is adapted to have less than 180, less than 170, less than 160, less than 150, less than 140, less than 130, less than 120 or less than 110 degrees of wrap contact.

One suitable method for using the apparatus depicted in FIGS. 7 and 8 includes providing a web 168 to the accumulator 162. The accumulator 162 may include a run condition as illustrated in FIG. 8 and a thread condition as illustrated in FIG. 7. In the thread condition, the subunits 152, 154, 156, and 158 of the second set of rolls 164 are pivoted such that the rolls that make up the subunits are essentially oriented in the vertical direction 45. Likewise, the subunits 151, 153, 155, and 157 are pivoted such that the rolls that make up the subunits are essentially oriented in the vertical direction 45. The second set of rolls 164 are then passed in the vertical direction 45 below the first set of rolls 162 such that the web 168 may then be passed directly through the accumulator 162 between the first set of rolls 162 and the second set of rolls 164 as illustrated in FIG. 7.

Once the web 168 is passed through the accumulator 162, the second set of rolls 164 is moved in the vertical direction 45 past the first set of rolls 162 to engage the web 168. The subunits 151, 152, 153, 154, 155, 156, 157 and 158 are pivoted such that the rolls that comprise the subunits are essentially oriented in the machine direction 44 resulting in the web path 169 illustrated in FIG. 8.

The web path 169 includes the web 168 being moved in the direction 166 to a first subset of rolls 151 in the first set of rolls 162. The web 168 sequentially contacts rolls 170 and 171, before making a web pass to a second subset of rolls 152. The second subset of rolls 152 includes rolls 172 and 173. The web 168 is sequentially moved past rolls 172 and 173 before making a web pass to roll 174. The web 168 continues to be alternated between two consecutive rolls in the first set of rolls 162 and two consecutive rolls in the second set of rolls 164 until the web passes roll 186 and exits the accumulator 160. The web path 169, as illustrated, is adapted such that the web 168 has less than 135 degrees of wrap contact with any given roll 170-186 as the web 168 is moved through the accumulator 160.

In various embodiments, each roll is adapted to have less than 180, less than 170, less than 160, less than 150, less than 140, less than 130, less than 120 or less than 110 degrees of wrap contact.

One suitable method for using the apparatus depicted in FIG. 9 includes providing a web 268 to the accumulator 260. The accumulator 260 may include a run condition as illustrated and a thread condition (not illustrated). In the thread condition, the second set of rolls 264 may be moved in the vertical direction 45 below the first set of rolls 262. The web 268 may then be passed directly through the accumulator 260 between the first set of rolls 262 and the second set of rolls 264. Once the web 268 is passed through the accumulator 260, the second set of rolls 264 is moved in the vertical direction 45 past the first set of rolls 262 to engage the web 268 thereby resulting in the web path 267 illustrated in FIG. 9. The web path 267 is defined by the web 268 being moved in the direction 266 to a first subset of rolls in the first set of rolls 262. The web 268 sequentially contacts rolls 270 and 271 before making a web pass to a second subset of rolls in the second set of rolls 264. The second subset of rolls includes rolls 272 and 273. The web 268 is moved sequentially past rolls 272 and 273 before making a web pass to roll 274 and roll 275. The web 268 continues to be alternated between two consecutive rolls in the first set of rolls 262 and two consecutive rolls in the second set of rolls 264 until the web 268 passes roll 290 and exits the accumulator 260. The web path 267, as illustrated, is adapted such that the web 268 has less than 135 degrees of wrap contact with any given roll 270-290 as the web 268 is moved through the accumulator 260. Each roll is adapted to form a part of the web path 267.

The accumulator 260 of FIG. 9 includes subsets of rolls having a first roll 292 and a second roll 294. The first roll 292 is the roll in any given subset that first contacts the web 268. The second roll 294 is the roll in any given subset that contacts the web 268 after the first roll 262. The method of using the apparatus of FIG. 9 includes contacting the first roll 292 with a first wrap contact angle and contacting the second roll 294 with a second wrap contact angle wherein the first wrap contact angle is less than the second wrap contact angle. For example, as illustrated in FIG. 9, the first rolls 292 have approximately 60 degrees of wrap contact angle and the second rolls 294 have approximately 120 degrees of wrap contact angle.

In various embodiments, the first roll 292 may be adapted to have less than 180, less than 170, less than 160, less than 150, less than 140, less than 130, less than 120, less than 110, less than 100, less than 90, less than 80, less than 70, less than 60, less than 50, less than 40, less than 30, less than 20 or less than 10 degrees of wrap contact.

In various embodiments, the second roll 294 may be adapted to have less than 180, less than 170, less than 160, less than 150, less than 140, less than 130, less than 120, less than 110, less than 100, less than 90, less than 80, less than 70, less than 60, less than 50, less than 40, less than 30, less than 20 or less than 10 degrees of wrap contact. In various embodiments, the wrap contact of the first roll 292 may be greater than, less than, or equal to the wrap contact of the second roll 294.

The accumulators and methods disclosed herein have been described having the sets of rolls moving relative to each other in the vertical direction. However, those skilled in the art will readily appreciate that the same principles are equally applicable to accumulators having the sets of rolls moving relative to each other in the horizontal direction (machine direction) or the cross-machine direction.

While the invention has been described in detail with respect to specific aspects thereof, it will be appreciated that those skilled in the art, upon attaining an understanding of the foregoing, may readily conceive of alterations to, variations of and equivalents to these aspects. Accordingly, the scope of the present invention should be assessed as that of the appended claims and any equivalents thereto.

The invention claimed is:

1. A method of accumulating and discharging a web comprising, a. providing a web to an accumulator;

b. providing a first set of rotatably mounted web rolls comprising at least one subset of rolls linked together and adapted to pivot;

c. providing a second set of rotatably mounted web rolls comprising at least one subset of rolls linked together and adapted to pivot;

d. pivoting the subsets of the first set and the subsets of the second set from a generally horizontal alignment to a generally vertical alignment;

e. moving the second set of rolls past the first set of rolls to define a thread condition;

f. passing the web between the first set of rolls and the second set of rolls;

g. moving the second set of rolls past the first set of rolls to engage the web;

h. pivoting the subsets of the first set and the subsets of the second set from the generally vertical alignment to the generally horizontal alignment to define a run condition;

i. moving the web alternatively between subsets of the first set and subsets of the second set; and j. moving the second set of rolls away from the first set of rolls to accumulate the web and moving the second set of rolls towards the first set of rolls to discharge the web.

2. The method of claim 1 wherein the web is extensible in the cross-machine direction.

3. The method of claim 2 wherein the web is elastic slit-necked spunbond.

4. The method of claim 3 further comprising moving the web with at least 0.075 pounds per lineal inch tension.

5. The method of claim 1 wherein the second set of web rolls are adapted to move vertically past the first set of web rolls when in the thread condition but not in the run condition.

6. The method of claim 1 wherein moving the second set of rolls past the first set of rolls further comprises aligning notches in a moveable carriage with portions of the support frame and aligning notches in a support frame with portions of the moveable carriage.

7. A web accumulator comprising, at least one first set and at least one second set of rotatably mounted web rolls, the accumulator having a thread condition and a run condition wherein the second set of web rolls is adapted to move past the first set of web rolls in the thread condition but not in the run condition.

8. The web accumulator of claim 7 wherein the first set of web rolls and the second set of web rolls have a diameter and comprise subsets of rolls comprising two rolls per subset, the subsets having a spacing less than one times the diameter.

9. The web accumulator of claim 7 wherein the first set of rolls and the second set of rolls comprise carbon fiber and have sleeves comprising fluoropolymer resins, clear epoxy coatings, nylon, or ultra high molecular weight polymers.

10. The web accumulator of claim 7 wherein the first set rolls are rotatably mounted to a fixed support structure and the second set of rolls are rotatably mounted to a moveable carriage.

11. The web accumulator of claim 10 wherein the moveable carriage comprises notches adapted to align with portions of the support structure and the fixed support structure comprises notches adapted to align with portions of the moveable carriage.

12. The web accumulator of claim 7 wherein at least one of the first and second web sets comprises at least two consecutive rolls linked together and adapted to pivot between a Thread condition and a run condition.

13. The web accumulator of claim 12 wherein the at least two consecutive rolls are staggered in the run condition.

14. The web accumulator of claim 12 wherein the at least two consecutive rolls are generally aligned in a machine direction in the run condition and generally aligned in a vertical direction in the thread condition.

15. The web accumulator of claim 14 wherein the first set and the second set of rolls have a diameter and comprise subsets of rolls comprising two rolls per subset, the subsets having a spacing less than one times the diameter.

16. A web accumulator comprising at least one first set of rolls comprising at least one subset having two consecutive staggered rolls;

at least one second set of rolls comprising at least one subset having two consecutive staggered rolls, the second set of rolls being adapted to move relative to the first set of rolls; and a web path defined by the two consecutive staggered rolls of the first set followed by the two consecutive staggered rolls of the second set.

17. The web accumulator of claim 16 wherein The first set of rolls comprises three or more subsets having two consecutive staggered rolls and the second set of rolls comprises three or more subsets having two consecutive staggered rolls and wherein the web path is adapted to sequentially alternate between subsets in the first set and subsets in the second set.

18. The web accumulator of claim 17 wherein the staggered rolls are overlapped in a machine direction.

19. The web accumulator of claim 17 wherein the subsets have a first roll and a second roll and wherein the second roll has a wrap contact angle and the first roll has a wrap contact angle less than the wrap contact angle of the second roll.

20. The web accumulator of claim 19 wherein the contact angle of the first roll is no greater than 60 degrees and the contact angle of the second roll is no less than 120 degrees.

* * * * *